United States Patent [19]

Little

[11] 4,036,426

[45] July 19, 1977

[54] METHOD OF CLEANING A CENTRIFUGE

[75] Inventor: Thomas Hamilton Little, Devon, Pa.

[73] Assignee: Pennwalt Corporation, Philadelphia, Pa.

[21] Appl. No.: 442,697

[22] Filed: Feb. 15, 1974

[51] Int. Cl.[2] ..... B04B 3/04

[52] U.S. Cl. ..... 233/7; 233/14 R

[58] Field of Search ..... 233/1 D, 2, 14 R, 14 A, 233/15, 27, 28, 12, 7

[56] References Cited

U.S. PATENT DOCUMENTS

| | | | |
|---|---|---|---|
| 2,283,457 | 5/1942 | Pecker | 233/2 X |
| 2,629,547 | 2/1953 | Orelind | 233/1 D |
| 2,685,369 | 8/1954 | Crossley | 233/14 R |
| 2,879,282 | 3/1959 | Afzelius | 233/14 R |
| 3,228,594 | 1/1966 | Amero | 233/14 R |
| 3,471,081 | 10/1969 | O'Conor | 233/14 R |
| 3,741,466 | 6/1973 | Weiland | 233/7 X |
| 3,747,843 | 7/1973 | Joyce | 233/1 D |
| 3,802,621 | 4/1974 | Merzenich | 233/7 |

*Primary Examiner*—GeorgeH. Krizmanich
*Attorney, Agent, or Firm*—Edward A. Sager

[57] ABSTRACT

The interior of a centrifuge is cleaned without disassembly by the steps of flushing the interior of the bowl, introducing a cleaning liquid to the bowl, and rotating the bowl at a low speed in which the centrifugal force and the gravitational force on the cleaning liquid are approximately equal. With this method, the bowl, an axial screw conveyor arranged coaxially within the bowl, and the surfaces of other parts within the bowl are all cleaned by the turbulent body of cleaning liquid. Optionally, the centrifuge bowl may be rotated unidirectionally, or it may be turned for a period of time first in one direction and then for an additional period of time in opposite direction. As a further option, the axial screw conveyor may be rotated at maximum speed differential from the rotational speed of the bowl in order to increase internal turbulence and thereby intensify agitation and scouring by the cleaning liquid.

12 Claims, No Drawings

METHOD OF CLEANING A CENTRIFUGE

BACKGROUND OF THE INVENTION

This invention relates to a method of cleaning the interior of a centrifuge. Preferably, this method is applied to centrifuges of the type having a bowl with a tapered end portion formed about a rotational axis and further provided with an axial screw conveyer. The screw conveyor is disposed coaxially within the bowl and adapted to be rotated at some selected, small differential in speed, relative to the rotational speed of the bowl. Such centrifuges are sometimes called decanter centrifuges. Although the invention is not so limited, the invention is especially applicable to a decanter centrifuge having its rotational axis disposed horizontally.

Centrifuges of the general type to which this cleaning method may be applied are disclosed in U.S. Pat. Nos. 2,679,974 and 2,703,676 of F. P. Gooch, also U.S. Pat. No. 3,148,145 of K. G. Reed, and U.S. Pat. No. 3,172,851 of C. M. Ambler, the disclosures of which are incorporated herein by reference. The cited patents are assigned to the assignee of the present invention.

Centrifuges of the type set forth are frequently used for processing edible or other materials requiring a high order of cleanliness. For this reason, it was previously necessary to disassemble and clean the interior of a centrifuge at the end of a shift or at the end of a workday. Disassembly is a time-consuming procedure, which the present invention seeks to avoid by providing a method of cleaning the interior of a centrifuge without any disassembly whatsoever, thereby effecting labor savings and decreasing downtime.

BRIEF DESCRIPTION OF THE INVENTION

According to the present invention the proposed cleaning process is practiced by shutting off feed, stopping the centrifuge, and flushing out process materials. A caustic liquid or other cleaning liquid is then introduced to the bowl; and the bowl is rotated at a slow speed. The centrifugal force developed by the cleaning liquid, which turns as the bowl turns, is preferably equal to or slightly less than the gravitational force imposed on such cleaning liquid. In this way, the cleaning liquid will not spin with the bowl in a complete circle about the horizontal axis; but rather it will "peel off" and spill into the bottom of the bowl, thereby creating turbulence which is effective for washing action. Next, the cleaning liquid is neutralized and the bowl flushed clear. Improved cleaing is achieved by repeating the aforementioned steps with the centrifuge bowl rotating in reverse direction. Cleaning is further improved with axial screw conveyor operated at maximum speed differential relative to the bowl.

DETAILED DESCRIPTION OF THE INVENTION

The present invention is directed to minimizing downtime and labor requirements in the cleaning of decanter centrifuges by eliminating disassembly and reassembly of the centrifuge at frequent intervals, e.g. one or more times each working day. Despite efforts to improve sanitation it has heretofore been impossible to effectively dislodge the residual solids or "cake" which builds up, during centrifugal operation, on internal parts, usually on the bowl wall and also on the flights and hub of the axial screw conveyor, either at the air-liquid interface within the bowl or between such interface and the axis of the machine.

In order to clean the centrifuge in place without disassembly, the following cleaning steps are proposed by the present invention:

1. The feed of process materials to the operating centrifuge is terminated.

2. The rotating bowl is flushed with water in order to displace process liquids and to float out loose solids.

3. If the centrifuge is equipped with internal spray wash nozzles, water is passed therethrough in order to augment the preceding flushing operation.

4. To the extent that the external surface of the centrifuge bowl is accessible, it is washed, preferably with a caustic material.

5. The application of turning force to the bowl is discontinued and the bowl is allowed to come to rest.

6. A caustic liquid or other suitable cleaning liquid is introduced to the centrifuge bowl until it is partially filled, that is, until it contains less than its volumetric capacity for normal process operation with the bowl rotating.

7. The centrifuge bowl is turned at a slow speed, usually in the range of 50 to 100 RPM — depending upon the diameter of the bowl — but in any event at a speed which develops a centrifugal force in the cleaning liquid which is approximately equal to or less than the gravitational force thereon (1 g). At this speed, the cleaning liquid falls downwardly from the bowl surface as the upper portion of the separating chamber is approached, and the resulting turbulence effects cleaning as the agitated cleaning liquid scours the internal parts it contacts.

8. It is desirable to continue feeding cleaning liquid into the bowl as it rotates in order to overflow cleaning liquid together with removed solids.

9. Optionally, but desirably, the bowl is rotated in reverse direction in order to ensure that cleaning during rotation in first direction is not so patterned that some areas with accumulated soil are missed.

10. Also optional, but desirable, is to rotate the axial screw conveyor at maximum possible speed differential relative to the bowl speed in order to promote the greatest turbulence and thereby effect maximum cleaning action.

11. The introduction of cleaning liquid and the rotation of the bowl in one or both directions for periods of 2 to 5 minutes and upwards in each direction is preferably repeated one or more times. By inspection of the overflowing cleaning liquid to determine the concentration of removed solids, it is possible to estimate the state of cleanliness of the bowl interior as the process continues.

12. A neutralizing flush is introduced while the bowl is rotating in order to displace and neutralize the cleaning liquid. If a caustic cleaning liquid is employed, an acidic neutralizing flush should be used.

13. A final water flush should by continued with the bowl rotating until all of the cleaning liquid and neutralizing flush is displaced, whereupon the centrifuge is again ready for operation.

With the foregoing method, residual solid matter in the bowl, both loose and adhered, can be readily loosened and purged from the bowl. The cleaning liquid is introduced to the bowl by same means ordinarily employed for introducing feed during normal centrifuge operation. However, as noted above, the 1 g low speed operation causes agitation and a continuous falling wave of cleaning liquid which travels up one side of the bowl wall and then tumbles downwardly, thereby scouring not only the bowl wall but also the conveyor flights and hub.

The additional scouring and agitation effected by operating the conveyor at a differential speed, e.g. 10 to 15 RPM relative to the speed of the bowl, results from wave action which submerges the conveyor flights in cleaning liquid even to the conveyor hub, thereby removing solids deposited at the normal air-liquid interface on the conveyor flights and also solid deposited by windage on the hub surface. All of the foregoing is accomplished without disassebly of the centrifuge and, therefore, is performed with little cost and at greater savings of time and labor.

It is recommended that each flushing, washing or neutralizing step be performed for at least 2 to 5 minutes. The recommended slow speed during cleaning for most industrial centrifuges with a horizontally disposed rotational axis will be in the order of 50 to 100 RPM, but more precisely the speed will be dictated by the centrifugal force imposed upon the annular layer of cleaning liquid which turns as the bowl turns, since it is preferred that the centrifugal force on the cleaning liquid be equal to or slightly less than the gravitational force on such cleaning liquid (1 g). In this way, the cleaning liquid will not spin with the bowl in a complete circle, but rather will "peel off" as that portion of the layer of cleaning liquid approaches a position over the horizonatal, rotational axis of the apparatus. Thus, cleaning liquid travels in an arcuate path from a lower portion of the separating chamber within the bowl to an upper portion of the separating chamber and then falls downwardly back into the bottom of the separation chamber, thereby creating turbulence which is effective for washing action. Cleaning will be improved if the aforementioned cleaning process is repeated while rotating the centrifuge bowl in reverse direction, and further improved by operating the axial screw conveyor at maximum speed differential relative to the bowl whereby agitation of cleaning liquid effected by the additionally created turbulence will clean the interior of the centrifuge more effectively. It is important that the neutralizing flush and water-wash steps be performed at the end of the cleaning operation before returning the centrifuge to process operation.

With cleaning operation disclosed herein, decanter centrifuges may be used more effectively for processing foods and other materials requiring a high standard of sanitation.

What is claimed is:

1. A method of cleaning a centrifuge after use for processing materials, said centrifuge having a bowl formed about a generally horizontal axis and being provided with an axial screw conveyor disposed coaxially therein, comprising the steps of:

a. emptying said bowl of process materials;

b. introducing cleaning liquid to said bowl;

c. rotating said bowl and said cleaning liquid therewith for a substantial period of time to impose upon said cleaning liquid by rotation a centrifugal force which is approximately equal to or less than the gravitational force on said cleaning liquid, whereby the axial screw conveyor and the interior of the bowl are cleaned by the agitating and tumbling action of the cleaning liquid; and d. emptying said bowl;

the step of introducing cleaning liquid to said bowl being performed by partially filling said bowl until it contains no more of said cleaning liquid than the volumetric capacity of the bowl for cleaning liquid during normal process operation with the bowl rotating.

2. A method according to claim 1 wherein the conveyor is rotated at a speed difference of 10 to 15 RPM from that of the bowl while said bowl is rotating as in step (c) of claim 1.

3. The method according to claim 1 wherein said cleaning liquid is introduced during rotation of said bowl.

4. The method according to claim 3 wherein the introduction of cleaning liquid to said bowl during rotation is performed continuously, whereby cleaning liquid overflows said bowl.

5. The method according to claim 1 wherein said bowl is rotated for a period of time first in one rotational direction and then for a period of time in opposite rotational direction.

6. The method according to claim 1 wherein said bowl is rotated for periods of time alternately in opposite rotational directions.

7. The method according to claim 1 wherein the step of emptying said bowl of process materials includes flushing said bowl with water to displace process liquids and solids from said bowl.

8. The method according to claim 1 wherein said cleaning liquid is a caustic liquid material.

9. The method according to claim 8 wherein the step of emptying the bowl of cleaning liquid includes the preliminary step of introducing an acidic flushing liquid in order to neutralize and displace said cleaning liquid from said bowl, and also the further step of introducing water to said bowl in order to flush residual cleaning liquid, solids, and the acidic flushing liquid from said bowl.

10. The method according to claim 1 wherein the step of rotating said bowl and said cleaning liquid therewith imposes centrifugal force upon said cleaning liquid which is slightly less than the gravitational force on said cleaning liquid.

11. The method according to claim 1 wherein the step of rotating said bowl effects rotation of said bowl in the range of approximately 50 to 100 rotations per minute.

12. A method according to claim 1 wherein the step of introducing cleaning liquid to said bowl is performed by partially filling said bowl until it contains less of said cleaning liquid than the volumetric capacity of the bowl for cleaning liquid during normal process operation with the bowl rotating.

* * * * *